US009157455B2

(12) United States Patent
Bilodeau et al.

(10) Patent No.: US 9,157,455 B2
(45) Date of Patent: Oct. 13, 2015

(54) AIRFLOW ASSEMBLY HAVING IMPROVED ACOUSTICAL PERFORMANCE

(75) Inventors: Mark L. Bilodeau, Burlington, MA (US); Mark D. Caplan, Westborough, MA (US); F. Raymond Cote, Dover, MA (US); Robert J. Van Houten, Winchester, MA (US)

(73) Assignee: Robert Bosch GmbH, Stuttgart (DE)

( * ) Notice: Subject to any disclaimer, the term of this patent is extended or adjusted under 35 U.S.C. 154(b) by 708 days.

(21) Appl. No.: 13/481,322

(22) Filed: May 25, 2012

(65) Prior Publication Data

US 2012/0301329 A1 Nov. 29, 2012

Related U.S. Application Data

(60) Provisional application No. 61/489,964, filed on May 25, 2011.

(51) Int. Cl.

| | |
|---|---|
| ***F04D 29/66*** | (2006.01) |
| ***F04D 29/54*** | (2006.01) |
| ***F01P 5/06*** | (2006.01) |

(52) U.S. Cl.

CPC ..... *F04D 29/547* (2013.01); *F01P 5/06* (2013.01); *F04D 29/663* (2013.01)

(58) Field of Classification Search

CPC ..... F01P 5/60; F04D 29/663; F04D 29/547
USPC ..... 415/119
See application file for complete search history.

(56) References Cited

U.S. PATENT DOCUMENTS

| | | | | |
|---|---|---|---|---|
| 2002/0067988 | A1 * | 6/2002 | Angelis | 415/211.2 |
| 2003/0183446 | A1 * | 10/2003 | Shah et al. | 181/205 |
| 2006/0048924 | A1 * | 3/2006 | Desai | 165/148 |
| 2006/0272800 | A1 * | 12/2006 | Wong et al. | 165/120 |
| 2008/0236518 | A1 * | 10/2008 | Schaffer et al. | 123/41.49 |
| 2008/0240913 | A1 | 10/2008 | Tsu et al. | |

FOREIGN PATENT DOCUMENTS

| | | |
|---|---|---|
| EP | 1340921 A2 | 9/2003 |
| EP | 1710413 A2 | 10/2006 |

OTHER PUBLICATIONS

International Search Report and Written Opinion in corresponding PCT Application (i.e., PCT/US2012/039677), completed Aug. 23, 2012 (10 pages).

* cited by examiner

*Primary Examiner* — Edward Look
*Assistant Examiner* — Aaron R Eastman
(74) *Attorney, Agent, or Firm* — Maginot, Moore & Beck LLP

(57) ABSTRACT

An airflow assembly, includes a plenum, a barrel, a fan support, a fan assembly, and a plurality of ribs. The plenum includes an opening structure defining a plenum opening. The barrel extends in a downstream direction from the opening structure, and defines a barrel space and a downstream edge. The fan support is at least partially positioned within the barrel space. The fan assembly is supported by the fan support and includes (i) a motor and (ii) a blade assembly configured to rotate about an axis. Each of the ribs extends between (i) the opening structure or the barrel and (ii) the fan support. The downstream direction is parallel to the axis. An upstream direction is opposite of the downstream direction and parallel to the axis. A plane intersects the axis and is perpendicular to the axis.

20 Claims, 12 Drawing Sheets

AIRFLOW ASSEMBLY HAVING IMPROVED ACOUSTICAL PERFORMANCE

This application claims the benefit of U.S. Provisional Application Ser. No. 61/489,964, filed May 25, 2011, the disclosure of which is incorporated herein by reference in its entirety.

FIELD

This patent relates generally to the field of airflow assemblies for use with an automotive engine cooling system, and more particularly to an airflow assembly exhibiting an improved acoustical performance.

BACKGROUND

Motor vehicles powered by an internal combustion engine typically include a liquid cooling system that maintains the engine at an operating temperature. The cooling system typically includes a liquid coolant, a heat exchanger, and an airflow assembly. A pump circulates the coolant through the engine and the heat exchanger, which is typically referred to as a radiator. The coolant extracts heat energy from the engine. As the coolant flows through the radiator, the heat energy extracted by the coolant is dissipated to atmosphere, thereby preparing the coolant to extract additional heat energy from the engine. To assist in dissipating the heat energy of the coolant, the radiator typically includes numerous fins that define many channels. As the vehicle is driven, ambient temperature air from atmosphere is directed through the channels to dissipate the heat energy.

The airflow assembly includes a shroud and a fan assembly. Typically, the shroud is positioned to cause the ambient temperature air from atmosphere to flow through the channels defined by the radiator, instead of blowing around the sides of the radiator. The fan assembly is typically connected to the shroud. When the fan assembly is operated it assists in moving air through the channels of the radiator, even when the vehicle is stationary. Operation of the fan assembly, however, typically causes the airflow assembly to generate some noise that may be objectionable to some users.

Accordingly, it is desirable to improve the airflow assembly so that the noise generated by the airflow assembly is unobjectionable to most users.

SUMMARY

According to one embodiment of the disclosure, an airflow assembly, includes a plenum, a barrel, a fan support, a fan assembly, and a plurality of ribs. The plenum includes an opening structure defining a plenum opening. The barrel extends in a downstream direction from the opening structure, and defines a barrel space and a downstream edge. The fan support is at least partially positioned within the barrel space. The fan assembly is supported by the fan support and includes (i) a motor and (ii) a blade assembly configured to rotate about an axis. Each of the ribs extends between (i) the opening structure or the barrel and (ii) the fan support. The downstream direction is parallel to the axis. An upstream direction is opposite of the downstream direction and parallel to the axis. A plane intersects the axis and is perpendicular to the axis. The downstream edge is of variable axial extent, and the barrel includes a first extent portion defining a first edge portion and a second variable portion defining a second edge portion. The first edge portion is spaced apart from the plane in the downstream direction. The second edge portion is spaced apart from the plane in the upstream direction. Each rib of the plurality of ribs (i) defines a first azimuthal extent, and (ii) extends from the opening structure or the barrel at a corresponding intersection region of the barrel. Each of the intersection regions defines a second azimuthal extent. Y equals the first azimuthal extent, X equals the second azimuthal extent, and $Y \leq X \leq 2.5Y$. The first extent portion extends between a first intersection region and a second intersection region. The second extent portion extends between the second intersection region and a third intersection region. The airflow assembly is configured to be associated with a vehicle having underhood components. At least one of the first extent portion and the second extent portion does not (i) serve as an attachment structure or a guiding structure for the underhood components or (ii) accommodate an edge of a reinforcing rib extending between the plenum and the barrel.

According to another embodiment of the disclosure, an airflow assembly includes a plenum, a shroud, a fan support, a fan assembly, a plurality of rib supports, a plurality of ribs, and at least one acoustic member. The plenum includes an opening structure defining a plenum opening. The shroud extends from the opening structure and defines a shroud space. The fan support is at least partially positioned within the shroud space. The fan assembly is supported by the fan support. The plurality of rib supports extend from the shroud. Each of the ribs extends between a corresponding one of the rib supports and the fan support. The at least one acoustic member extends from the shroud and is (i) circumferentially interposed between a corresponding circumferentially adjacent pair of the rib supports, and (ii) spaced apart from each of the corresponding circumferentially adjacent pair of the rib supports.

According to yet another embodiment of the disclosure, an airflow assembly includes a plenum, a shroud, a fan support, a fan assembly, a plurality of rib supports, a plurality of ribs, and at least one acoustic member. The plenum includes an opening structure defining a plenum opening. The shroud extends from the opening structure and defines a shroud space. The fan support is at least partially positioned within the shroud space. The fan assembly is supported by the fan support and includes a blade assembly configured to rotate about an axis. The plurality of rib supports extends from the shroud. Each of the ribs extends between a corresponding one of the rib supports and the fan support. The at least one acoustic member extends from the shroud. A plane intersects the axis and is perpendicular to the axis. Each of the rib supports includes a first edge positioned in the plane. The acoustic member includes a second edge. At least a portion of the second edge is spaced apart from the plane.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
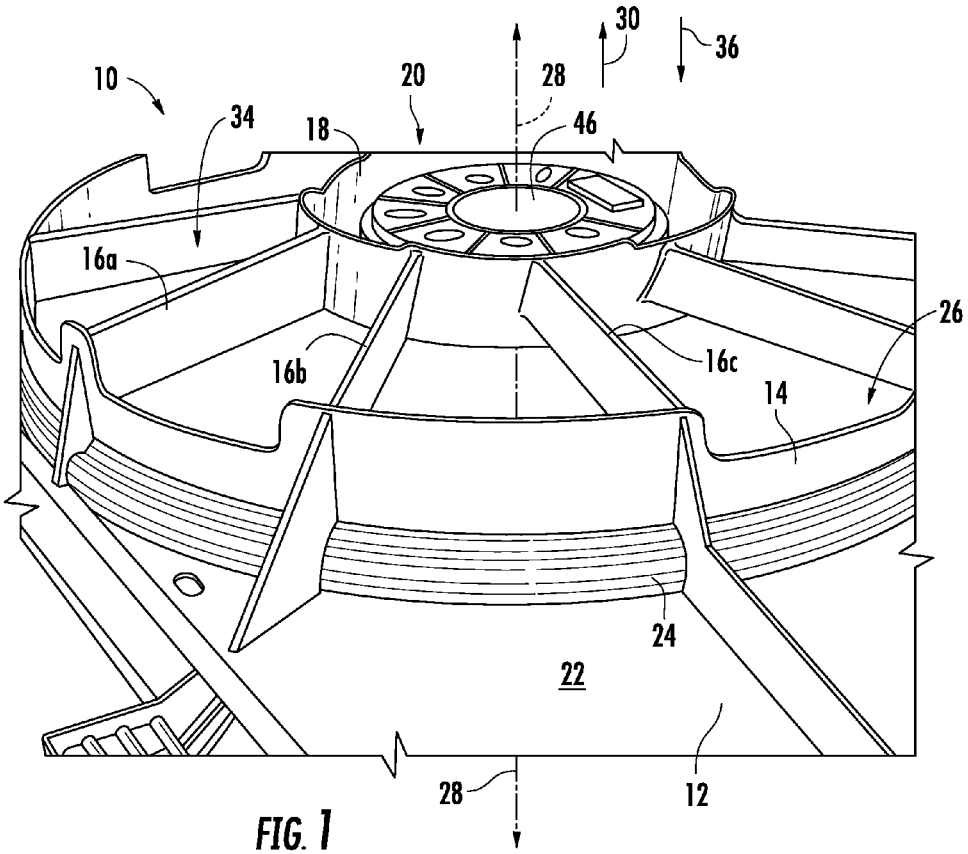
FIG. 1 is a perspective view of a downstream side of an airflow assembly, as described herein.

For the purpose of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one skilled in the art to which this disclosure pertains.

As shown in FIG. 1, an airflow assembly 10 includes a plenum 12, a barrel 14, ribs 16, a fan support 18, and a fan assembly 20. The plenum 12 includes an air guide structure 22 and an opening structure 24. The air guide structure 22 is generally rectangular. The plenum 12 is typically positioned near a heat exchanger (not shown) to enable the air guide structure 22 to direct an airflow through the heat exchanger. The opening structure 24 is a generally circular structure that defines a plenum opening 26. The opening structure 24 and the plenum opening 26 are centered about an axis 28.

The barrel 14 extends from the opening structure 24 in a downstream direction 30, which is parallel to the axis 28. The barrel 14 is generally cylindrical and is centered about the axis 28. The barrel 14 defines a downstream edge 32 of variable axial extent. The barrel 14 further defines a barrel space 34, which is a generally cylindrical space that is bounded by the barrel 14 and extends along the axis 28. As defined herein, the downstream direction 30 is parallel to the axis 28, and an upstream direction 36 is opposite of the downstream direction and is also parallel to the axis 28.

The ribs 16 extend generally radially inward from the barrel 14 toward the axis 28. The ribs 16 are connected to the fan support 18; accordingly, the ribs extend between the barrel 14 and the fan support 18. The ribs 16 position the fan support 18 at least partially in the barrel space 14. In an alternative embodiment, the ribs 16 extend generally radially inward from the opening structure 24. In yet another alternative embodiment, at least one of the ribs 16 extends radially inward from the barrel 14 and at least another one of the ribs extends radially inward from the opening structure 24.

Figure 2:
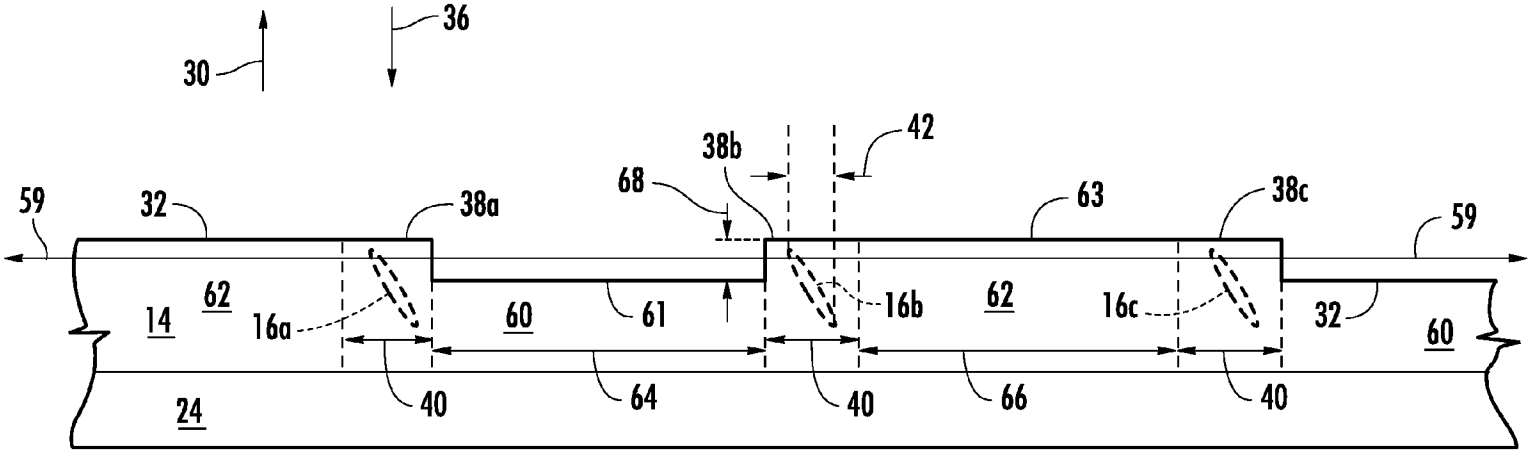
FIG. 2 is a side elevational view of a portion of the airflow assembly of FIG. 1 showing a barrel of the airflow assembly in an "unrolled" orientation, such that the barrel is shown lying in a plane.

As shown in FIG. 2, the ribs 16*a*, 16*b*, 16*c* (shown in phantom) extend from the barrel 14 at an intersection region 38*a*, 38*b*, 38*c* of the barrel. An azimuthal extent 40 (referred to as "X") defined by the intersection region 38 may be based on an azimuthal extent 42 (referred to as "Y") defined by the ribs 16. Specifically, the azimuthal extent 40 (shown as a linear extent in FIG. 2) of the intersection region 38 may be greater than or equal to the azimuthal extent 42 (shown as a linear extent in FIG. 2) of the ribs 16 and may be less than or equal to 2.5 times the azimuthal extent 42 of the ribs 16. In the embodiment shown in FIGS. 1-3, the azimuthal extent 40 of the intersection region 38 is approximately 2.0 times the azimuthal extent 42 of the ribs 16.

With reference again to FIG. 1, the fan support 18 is at least partially positioned in the barrel space 34. The fan support 18 is supports any type of fan assembly 20 that is usable with the airflow assembly 10. The fan support 18 positions the fan assembly 20 at least partially in the barrel space 34.

Figure 3:
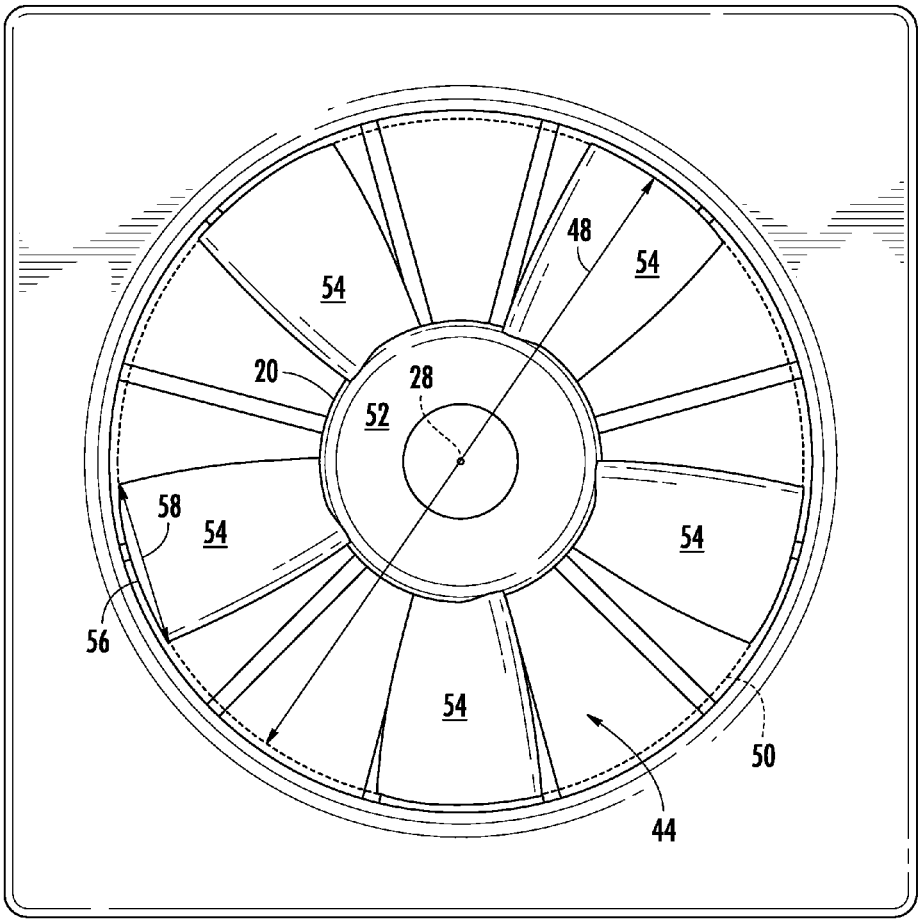
FIG. 3 is an elevational view of an upstream side of the airflow assembly of FIG. 1.

As shown in FIG. 3, the fan assembly 20 includes a motor 46 (FIG. 1) and a blade assembly 44 that rotates about the axis 28. In the illustrated embodiment, as the blade assembly 44 rotates in a path of movement about the axis 28 it is a generatrix, in that it defines a generally cylindrical shape having a diameter 48. A circumference of the cylindrical shape is shown by the dashed circle 50. In other embodiments, rotation of the blade assembly 44 about the axis 28 may not define a generally cylindrical shape.

The blade assembly 44 includes a hub 52 and a plurality of blades 54. The hub 52 is centered about the axis 28. The blades 54 extend radially outward from the hub 52. Each of the blades 54 includes a terminal edge 56 that defines a tip length 58 (referred to as "T"). The blade assembly 44 is rotated about the axis 28 by the motor 46, which may be any type motor including, but not limited to, electric motors (such as electronically commutated motors) and hydraulic motors.

The plenum 12, the barrel 14, the ribs 16, and the fan support 18 are all integrally formed from injection molded thermoplastic.

With reference again to FIG. 2 and as briefly described above, the downstream edge 32 of the barrel 14 is of variable axial extent with respect to the axis 28 (FIG. 1). The variable axial extent of the downstream edge 32 is described herein with reference to a plane 59 that intersects the axis 28 and is perpendicular thereto.

The downstream edge 32 includes a first extent portion 60 defining an edge 61 and a second extent portion 62 defining an edge 63. The first extent portion 60 extends between the intersection region 38*a* and the intersection region 38*b* and the edge 61 is spaced apart from the plane 59 in the downstream direction 30. The first extent portion 60 defines an azimuthal extent 64 (referred to as "Z", and shown as a linear extent in FIG. 2) that may be based on the tip length 58. In particular, the azimuthal extent 64 may be greater than or equal to 25% of the tip length 58 and less than or equal to 600% of the tip length 58. As shown in the illustrated embodiment, the azimuthal extent 64 is approximately 100% of the tip length 58.

The second extent portion 62 extends between the intersection region 38*b* and the intersection region 38*c* and the edge 63 is spaced apart from the plane 59 in the upstream direction 36. The second extent portion 62 defines an azimuthal extent 66 (shown as a linear extent in FIG. 2) that may also be based on the tip length 58. In particular, the azimuthal extent 66 may be greater than or equal to 25% of the tip length 58 and less than or equal to 600% of the tip length. As shown in the illustrated embodiment, the azimuthal extent 66 is approximately 100% of the tip length 58. The alternating arrangement of the first extent portion 60 and the second extent portion 62 may continue completely around the barrel 14.

The second extent portion 62 is spaced apart from the first extent portion 60 for a distance 68 that is measured parallel to the downstream direction 30. The distance 68 exemplifies of the variable axial extent of the downstream edge 32. In at least some embodiments, the distance 68 is based on the diameter 48 of the cylinder outlined by dashed circle 50. In particular, a ratio of the distance 68 to the diameter 48 (referred to as "β") may be greater than 0.015 and less than 0.300.

In operation, the airflow assembly 10 is typically associated with a liquid cooling system of an automobile or other vehicle (not shown). When the motor 46 is energized, the blade assembly 44 rotates relative to the plenum 12 and generates an airflow in the downstream direction 30. The airflow draws air through a heat exchanger (not shown) of the cooling system. After flowing through the heat exchanger, the plenum 12 guides the airflow to the barrel 14 (which is also referred to as a shroud in other embodiments described herein). Then the fan assembly 20 moves the airflow through the plenum opening 26 and then through the barrel 14.

The variable axial extent of the downstream edge 32 improves the characteristics of the noise that is generated by the airflow assembly 10, thereby making the noise unobjectionable to most users. In particular, the first extent portion 60 and the second extent portion 62 affect the airflow that passes through the plenum opening 26 and operate to cancel certain frequencies of noise. The frequencies that are canceled are a function of the distance 68, the azimuthal location and extent of the extent portions 60, 62, and the number of extent portions, among others factors and considerations. By adjusting the distance 68, each portion of the barrel 14 positioned between two azimuthally adjacent intersection regions (such as 38*a* and 38*b*) can be "tuned" to have a beneficial effect on the noise characteristics of the airflow assembly 10.

Underhood components (not shown) of the vehicle with which the airflow assembly 10 is associated are prevented from being positioned near the downstream edge 32, since placing components such as electrical wire harnesses, hoses, and the like near the downstream edge may change the way that the extent portions 60, 62 affect the airflow that passes through the plenum opening 26, with the result that the acoustic performance of the airflow assembly 10 may be adversely altered. Additionally, underhood components of the vehicle are prevented from being attached to the extent portions 60, 62 to prevent changes in the acoustic performance of the airflow assembly. In this way, the extent portions 60, 62 do not serve as attachment structures for the underhood components. Furthermore, the extent portions 60, 62 do not accommodate an edge of a reinforcing rib (not shown) extending between the plenum 12 and the barrel 14, as is typically found in the reinforcing ribs that connect the plenum to a radiator end tank attachment location (not shown). As used herein, an underhood component is a vehicle component positioned in the engine compartment of a vehicle.

Figure 4:
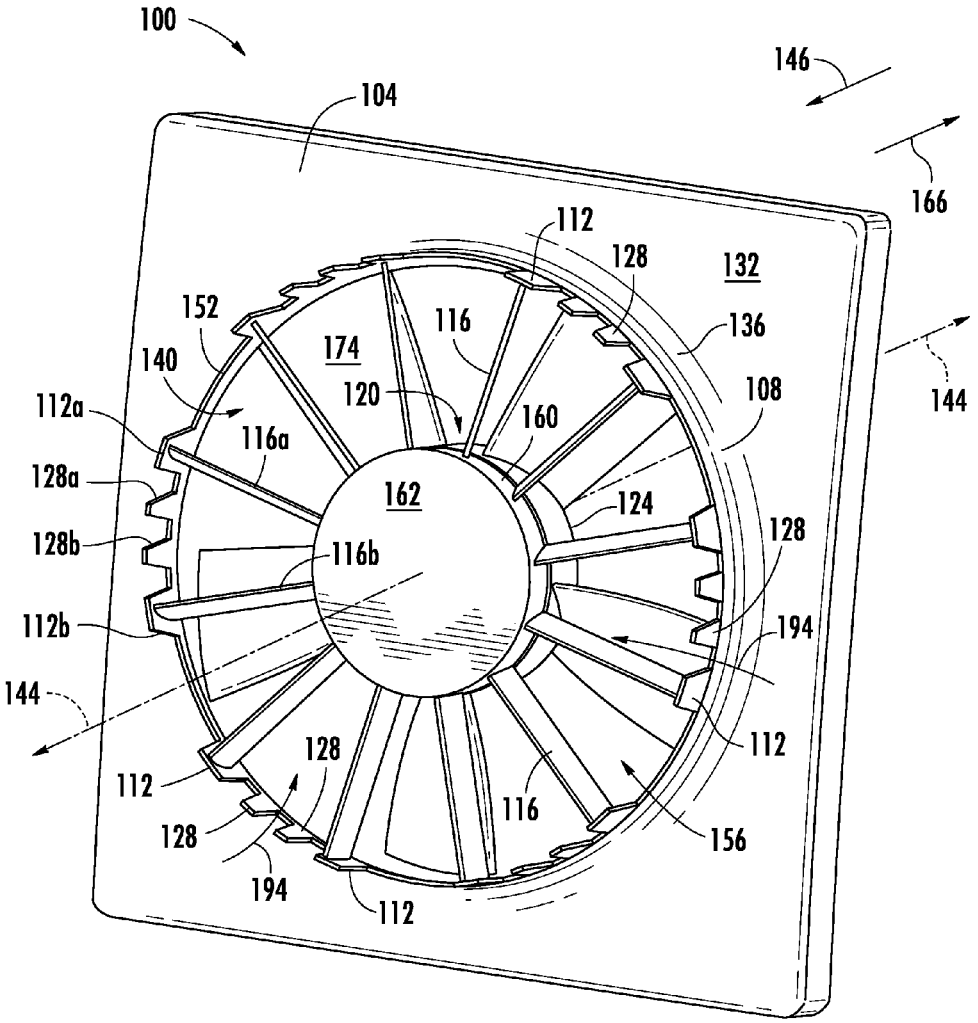
FIG. 4 is a perspective view of a downstream side of another embodiment of an airflow assembly, including a blade assembly positioned on an upstream side of a plenum of the airflow assembly.

As shown in FIG. 4, another airflow assembly 100 includes a plenum 104, a shroud 108, rib supports 112, ribs 116, a fan support 120, a fan assembly 124, and acoustic members 128. The plenum 104 includes an air guide structure 132 and an opening structure 136. The air guide structure 132 is generally rectangular. The plenum 104 is typically positioned near a heat exchanger (not shown) to enable the air guide structure 132 to direct an airflow through the heat exchanger. The opening structure 136 is a generally circular structure that defines a plenum opening 140. The opening structure 136 and the plenum opening 140 are centered about an axis 144.

The shroud 108 extends from the opening structure 136 in a downstream direction 146, which is parallel to the axis 144. The shroud 108 is generally cylindrical and is centered about the axis 144. The shroud 108 defines a downstream edge 152 that is positioned in a shroud plane 154 (FIG. 6), which intersects the axis 144 and is perpendicular thereto. The shroud 108 further defines a shroud space 156, which is a cylindrical space that is bounded by the shroud 108 and extends along the axis 144.

The rib supports 112 extend from the edge 152 of the shroud 108 in the downstream direction 146. The airflow assembly 100 includes a plurality of the rib supports 112. In the embodiment of FIG. 4, the fan assembly 100 includes twelve (12) of the rib supports 112 (not all of which are labeled in FIG. 4), which are spaced apart from each other. It is noted that other embodiments of the fan assembly may include a different number of the rib supports 112. The rib supports 112 are distributed circumferentially around the shroud 108.

Figure 6:
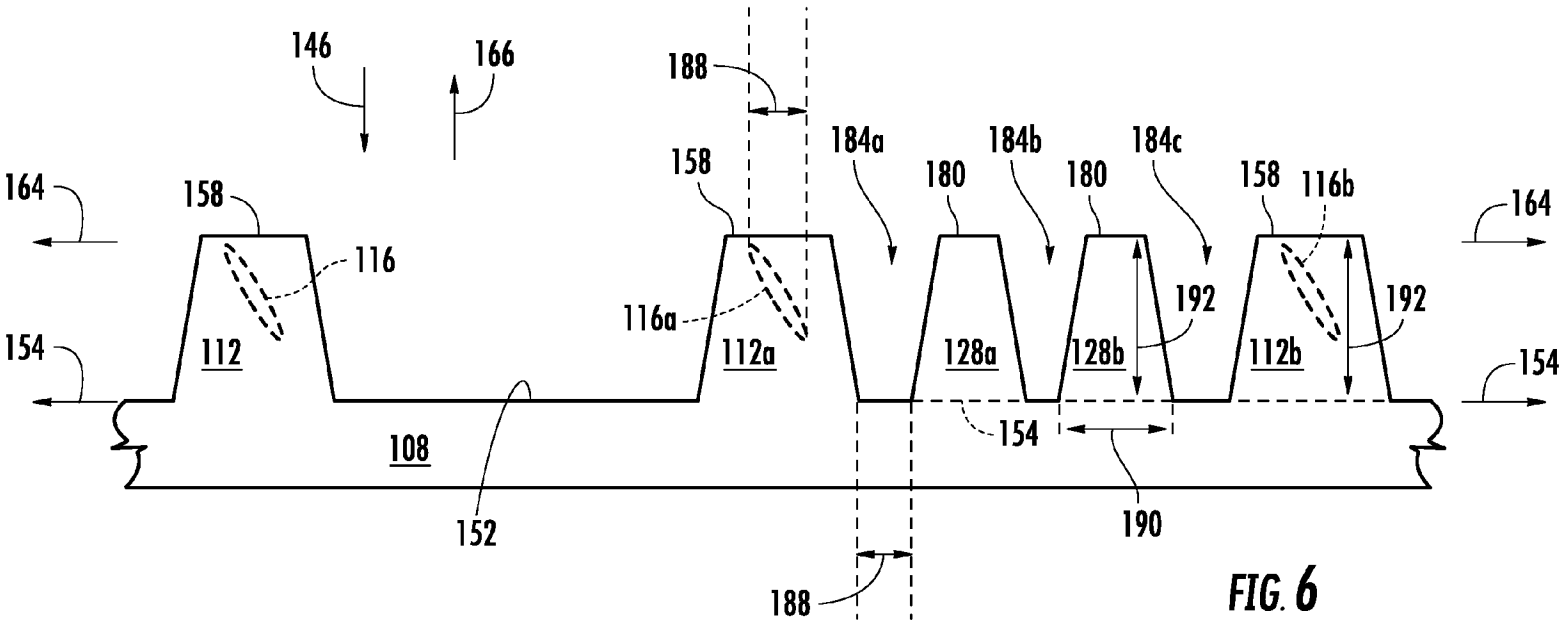
FIG. 6 is a side elevational view of a portion of the airflow assembly of FIG. 4 showing acoustic members and rib supports extending from a generally cylindrical shroud of the airflow assembly, with the shroud, the acoustic members, and the rib supports in an "unrolled" orientation, such that the shroud, the rib supports, and the acoustic members are shown lying in a common plane.

The rib supports 112, in the embodiment of FIG. 4, have a generally trapezoidal shape. Each of the rib supports 112 defines a downstream edge 158 (FIG. 6) that is positioned in a plane 164 (FIG. 6). The plane 164 intersects the axis 144 and is perpendicular thereto. Other embodiments of the fan assembly 124 may include rib supports 112 that have a different shape such as square, rectangular, or any other shape.

The ribs 116 extend generally radially inward from the rib supports 112 toward the axis 144. The ribs 116 are connected to the fan support 120; accordingly, the ribs extend between the rib supports 112 and the fan support 120. The ribs 116 position the fan support 120 at least partially in the shroud space 156.

The fan support 120 is at least partially positioned in the shroud space 156. The fan support 120 supports the fan assembly 124 and positions the fan assembly at least partially in the shroud space 156. The fan support 120 includes a cylindrical member 160 extending from a cover 162. The cylindrical member 160 extends in an upstream direction 166, which is parallel to the axis 144. The cylindrical member 160 receives at least a portion of the fan assembly 124. Other embodiments of the fan support 120 may be provided without the cover 162, such that the fan support is open on both the upstream side and the downstream side. Still other embodiments of the fan support 120 have a shape that is dependent on the shape of the motor (see motor 46 of FIG. 1). For example, some motors have a generally rectangular periphery and the fan support may be correspondingly shaped to receive the motor.

The fan assembly 124 includes a blade assembly 168 and a electric motor (see motor 46 of FIG. 1). In the embodiment of FIG. 4, as the blade assembly 168 rotates in a path of movement about the axis 144 it is a generatrix, in that it defines a generally cylindrical shape. The circumference of the cylindrical shape is shown by the dashed circle 169. The cylindrical shape defined by the blade assembly 168 has a diameter 170.

Figure 5:
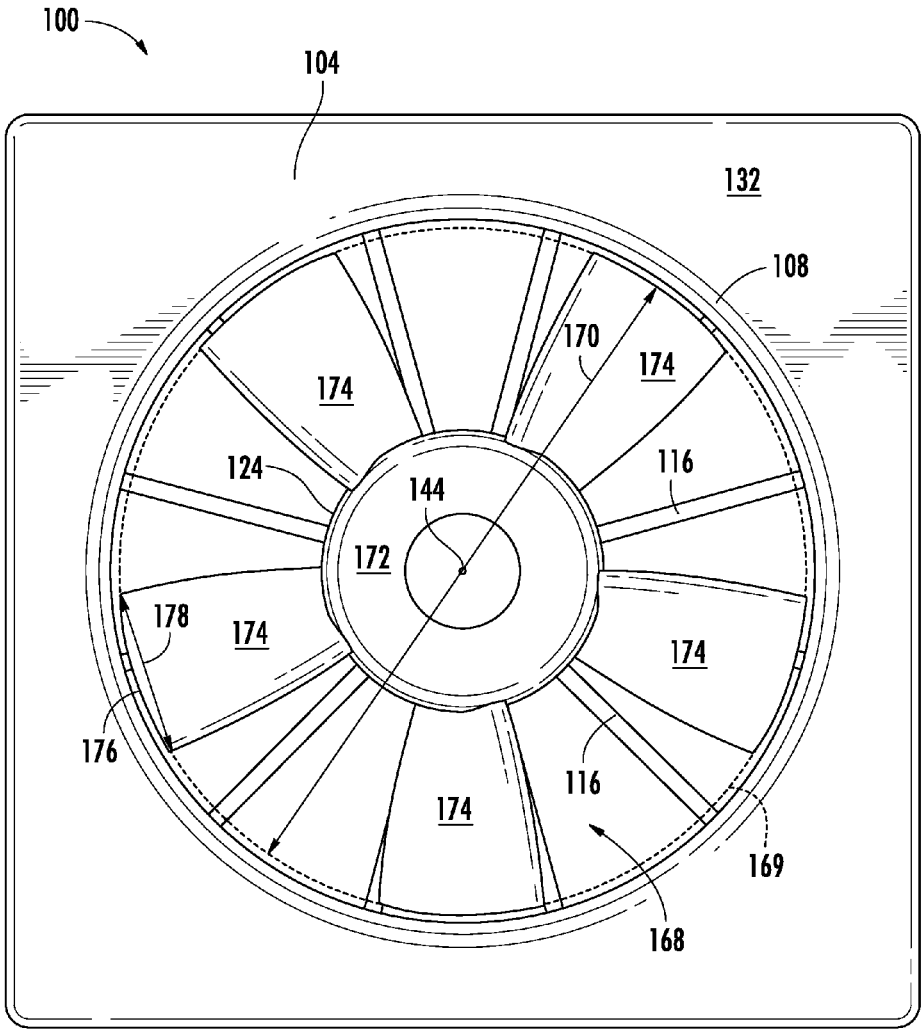
FIG. 5 is an elevational view of an upstream side of the airflow assembly of FIG. 4.

As shown in FIG. 5, the blade assembly 168 includes a hub 172 and blades 174. The hub 172 is centered about the axis 144. The blades 174 extend radially outward from the hub 172. Each of the blades 174 includes a terminal edge 176 that defines a tip length 178. The blade assembly 168 is rotated about the axis 144 by the motor.

With reference again to FIG. 4, the airflow assembly 100 includes a plurality of acoustic members 128. In the embodiment of FIG. 4, twelve (12) of the acoustic members 128 are shown. The acoustic members 128 have a generally trapezoidal shape (the acoustic members may have other shapes, as described herein), and each of the acoustic members is circumferentially interposed between a corresponding circumferentially adjacent pair of rib supports 112. That is, the rib supports 112*a*, 112*b* are circumferentially adjacent and the acoustic members 128*a*, 128*b* are circumferentially interposed therebetween. As used throughout this patent document, a reference numeral followed by a letter (e.g. 112*a*, for the rib support located at approximately the 9 o'clock position in FIG. 4) refers to a particular one of a plurality of things, which are referred to collectively by the reference numeral without a terminal letter (e.g. 112, for all of the rib supports of the airflow assembly 100)

As shown in FIG. 6, a portion of the shroud 108 is shown in an "unrolled," "unfurled," or "unwrapped" orientation to illustrate the configuration of the acoustic members 128 and the rib supports 112 with respect to the shroud 108. In this orientation, the normally cylindrical shroud 108 is shown as it would appear unrolled onto a plane. The acoustic members 128*a*, 128*b* are spaced apart from each other and are spaced apart from the circumferentially adjacent rib supports 112*a*, 112*b*, as well as each other rib support 112. In particular, a gap space 184*a* separates the rib support 112*a* from the acoustic member 128*a*, a gap space 184*b* separates the acoustic member 128*a* from the acoustic member 128*b*, and a gap space 184*c* separates the acoustic member 128*b* from the rib support 112*b*. In the embodiment of FIG. 6, the gap spaces 184 are approximately equal to a circumferential width 188 of the ribs 116 (shown in phantom in FIG. 6). The gap spaces 184 may have a different width in other embodiments.

The acoustic members 128 define a circumferential width 190 (also referred to as an azimuthal width), which is shown as a linear width in FIG. 6. The circumferential width 190 is the width of the acoustic members 128 at the edge 152 of the shroud 108. In the embodiment of FIG. 6, each of the acoustic members 128 has the same circumferential width 190.

The acoustic members 128 extend from the shroud 108 in the downstream direction 146 for a distance 192. The distance 192 is measured from the edge 152 to a downstream edge 180 of each of the acoustic members 128, which is positioned in the plane 164. Each of the acoustic members 128 extends for the distance 192.

The plenum 104, the shroud 108, the rib supports 112, the ribs 116, the fan support 120, and the acoustic members 128 are all integrally formed from injection molded thermoplastic.

The acoustic members 128 improve the characteristics of the noise that is generated by the airflow assembly 100 in a manner that is similar to the way in which the variable axial extent of the downstream edge 32 of the barrel 14 improves the characteristics of the noise that is generated by the airflow assembly 10.

Other components (not shown) of the vehicle with which the airflow assembly 100 is associated are prevented from being positioned within the gap spaces 184. Placing components such as electrical wire harnesses, hoses, and the like in the gap spaces 184 changes the way that the acoustic members affect the airflow that passes through the plenum opening, with the result that the acoustic performance of the airflow assembly 100 is changed. Additionally, the other components of the vehicle are prevented from being attached to the acoustic members 128 to prevent changes in the acoustic performance of the airflow assembly.

FIGS. 7 through 16 show alternative embodiments of the airflow assembly 100 having differently shaped acoustic members 128 and rib supports 112. Unless otherwise described below, the embodiments of the airflow assembly shown in FIGS. 7-16 are identical to the airflow assembly 100. Additionally, the embodiments described below include acoustic members that improve the characteristics of the noise that is generated by the various airflow assemblies in a manner that is similar to the way in which the variable axial extent of the downstream edge 32 of the barrel 14 improves the characteristics of the noise that is generated by the airflow assembly 10.

Figure 7:
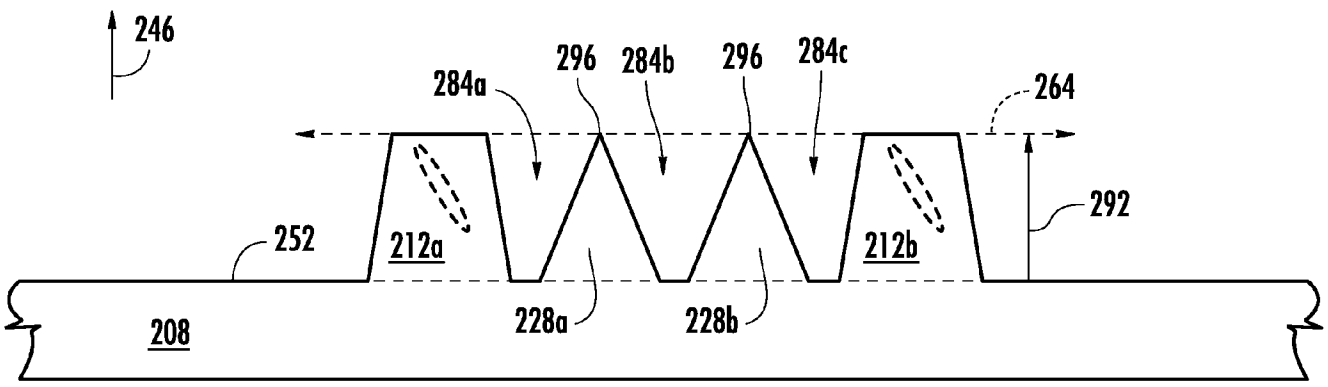
FIG. 7 is a side elevational view showing another embodiment of the acoustic members in an orientation similar to FIG. 6.

As shown in FIG. 7, a plurality of acoustic members 228 have a generally triangular shape. A gap space 284*a* separates a rib support 212*a* from the acoustic member 228*a*, a gap space 284*b* separates the acoustic member 228*a* from the acoustic member 228*b*, and a gap space 284*c* separates the acoustic member 228*b* from a rib support 212*b*.

The acoustic members 228 extend from a shroud 208 in a downstream direction 246 for a distance 292. The distance 292 is measured from an edge 252 of the shroud 208 and extends to a terminal tip 296 of the acoustic members 228. The rib supports 212 also extend from the edge 252 for the distance 292. The terminal tips 296 and the edges 252 of the rib supports 212 are positioned in a plane 264.

The acoustic members 228 operate in the same manner as the acoustic members 128 to improve the noise characteristics of the airflow apparatus with which they are associated.

Figure 8:
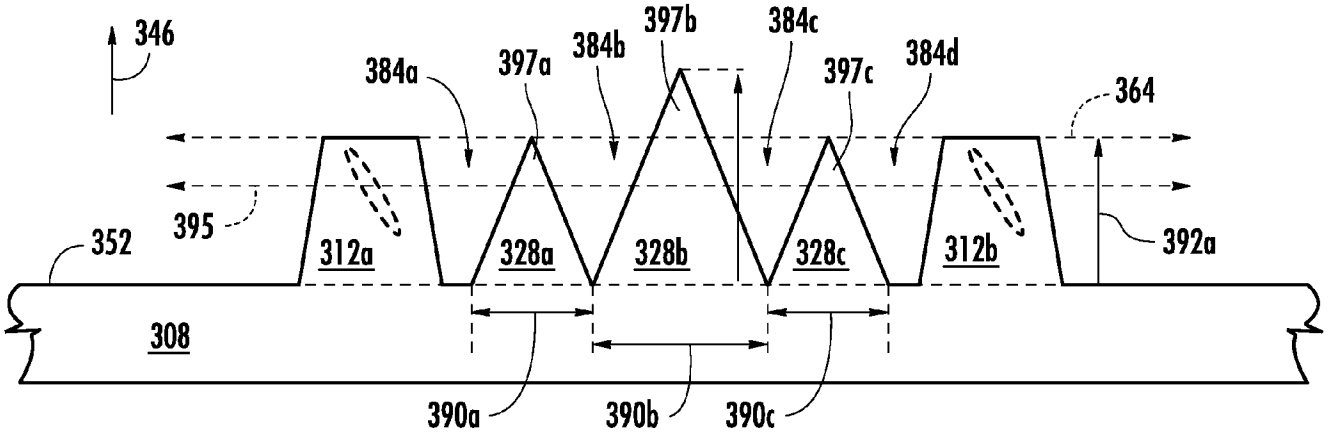
FIG. 8 is a side elevational view showing another embodiment of the acoustic members in an orientation similar to FIG. 6.

As shown in FIG. 8, acoustic members 328 have a generally triangular shape with the acoustic member 328*b* having a circumferential width 390*b* that is larger than circumferential widths 390*a*, 390*c* of the acoustic members 328*a*, 328*c*. The acoustic member 328*a* defines a triangular member, the acoustic member 328*b* defines a triangular member, and the acoustic member 328 defines a triangular member. The triangular member defined by the acoustic member 328*b* is larger than the triangular member defined by the acoustic member 328*a* and the triangular member defined by the acoustic member 328*c*.

A gap space 384*a* separates a rib support 312*a* from the acoustic member 328*a*, a gap space 384*b* separates the acoustic member 328*a* from the acoustic member 328*b*, a gap space 384*c* separates the acoustic member 328*b* from the acoustic member 328*c*, and a gap space 384*d* separates the acoustic member 328*c* from a rib support 312*b*.

The acoustic members 328*a*, 328*c* extend from the edge 352 of a shroud 308 in a downstream direction 346 for a distance 392*a* to a plane 364. The rib supports 312 also extend from the shroud 308 for the distance 392*a*. The acoustic member 328*b* extends from the shroud in the downstream direction 346 for a distance 392*b*, which is greater than the distance 392*a*.

A plane 395 intersects the acoustic members 328 to define terminal end portions 397 of the acoustic members, which extend in the downstream direction 346 from the plane 395. The plane 395 intersects the axis 140 (FIG. 4) and is perpendicular thereto. The terminal end portion 397*b* defines a triangular member that is larger than the triangular member defined by the terminal end portions 397*a*, 397*c*.

Figure 9:
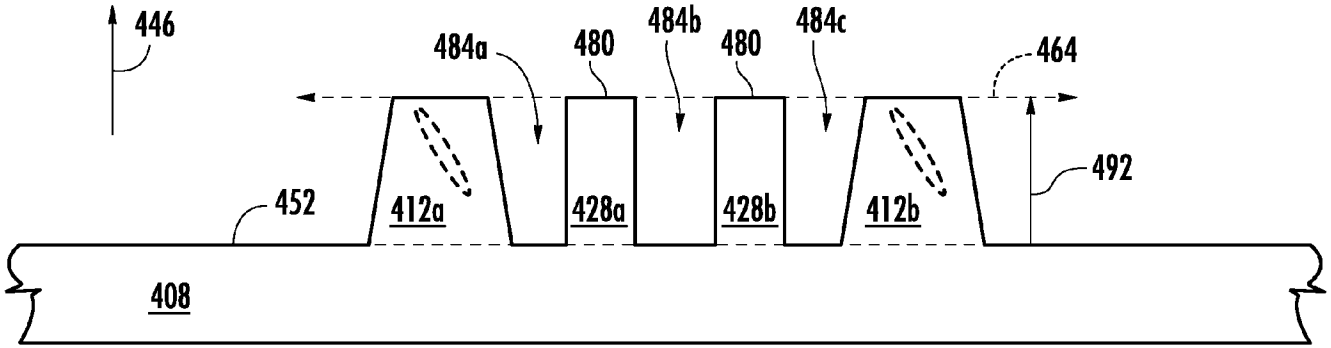
FIG. 9 is a side elevational view showing another embodiment of the acoustic members in an orientation similar to FIG. 6.

As shown in FIG. 9, acoustic members 428 have a generally rectangular shape. A gap space 484*a* separates a rib support 412*a* from the acoustic member 428*a*, a gap space 484*b* separates the acoustic member 428*a* from the acoustic member 428*b*, and a gap space 484*c* separates the acoustic member 428*b* from a rib support 412*b*.

The acoustic members 428 extend from an edge 452 of a shroud 408 in a downstream direction 446 for a distance 492 to a plane 464. A downstream edge 480 of each of the acoustic members 428 is positioned in the plane 464. The rib supports 412 also extend from the shroud 408 for the distance 492.

Figure 10:
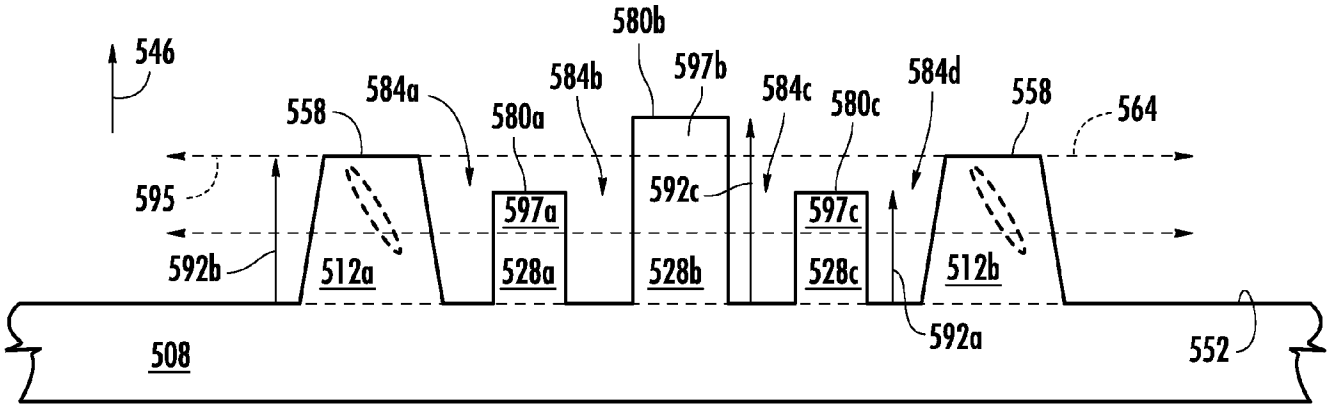
FIG. 10 is a side elevational view showing another embodiment of the acoustic members in an orientation similar to FIG. 6.

As shown in FIG. 10, acoustic members 528 have a generally rectangular shape. A gap space 584*a* separates a rib support 512*a* from the acoustic member 528*a*, a gap space 584*b* separates the acoustic member 528*a* from the acoustic member 528*b*, a gap space 584*c* separates the acoustic member 528*b* from the acoustic member 528*c*, and a gap space 584*d* separates the acoustic member 528*c* from a rib support 512*b*.

The acoustic members 528*a*, 528*c* extend from an edge 552 of a shroud 508 in a downstream direction 546 for a distance 592*a*. The rib supports 512 extend from the edge 552 in the downstream direction 546 for a distance 592*b*, which is greater than the distance 592*a*. The acoustic member 528*b* extends from the edge 552 in the downstream direction 546 for a distance 592*c*, which is greater than the distance 592*a* and the distance 592*b*.

The acoustic members 528 each define a downstream edge 580. The downstream edges 580 are spaced apart from the plane 564. The rib supports 512 each define a downstream edge 558 that is positioned in the plane 564.

A plane 595 intersects the acoustic members 528 to define terminal end portions 597 of the acoustic members, which extend in the downstream direction 546 from the plane 595. The terminal end portion 597*b* defines a rectangular member that is larger than the rectangular members defined by the terminal end portions 597*a*, 597*c*.

Figure 11:
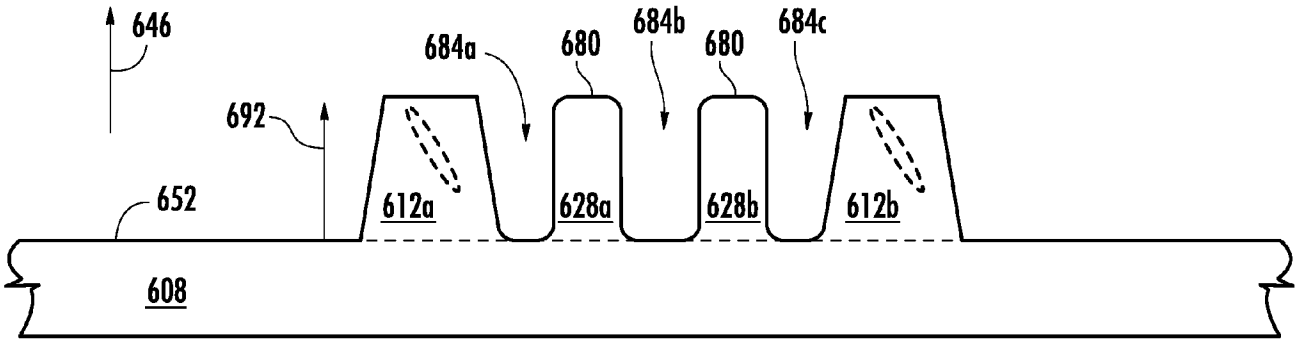
FIG. 11 is a side elevational view showing another embodiment of the acoustic members in an orientation similar to FIG. 6.

As shown in FIG. 11, acoustic members 628 have a generally rounded rectangle shape. A gap space 684*a* separates a rib support 612*a* from the acoustic member 628*a*, a gap space 684*b* separates the acoustic member 628*a* from the acoustic member 628*b*, and a gap space 684*c* separates the acoustic member 628*b* from a rib support 612*b*. The acoustic members 628 extend from a shroud 608 in a downstream direction 646 for a distance 692.

Figure 12:
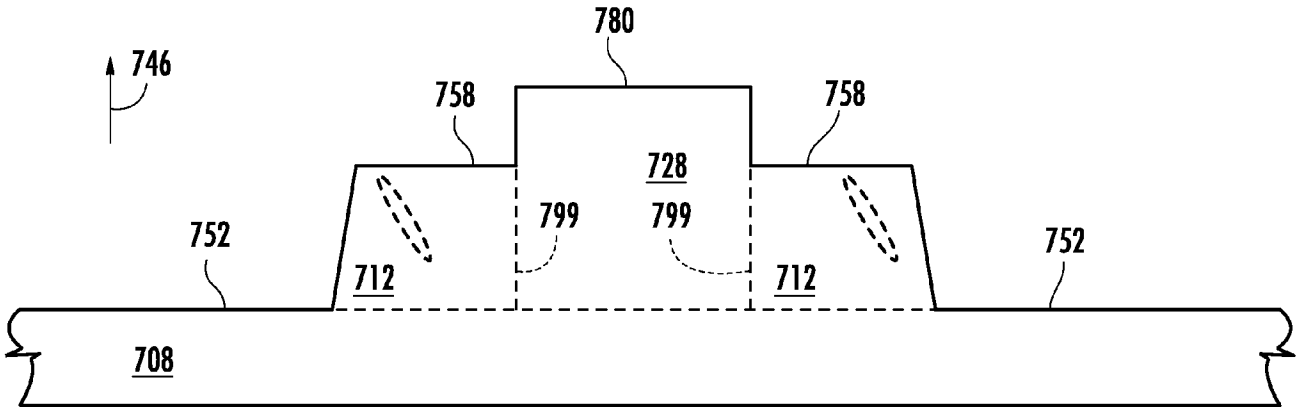
FIG. 12 is a side elevational view showing another embodiment of the acoustic members and the rib supports in an orientation similar to FIG. 6.

As shown in FIG. 12, an acoustic member 728 extends from a shroud 708 and is integrally formed with rib supports 712. Vertical lines 799 define boundaries between the rib supports 712 and the acoustic member 728. The acoustic member 708 includes a linear downstream edge 780 that is spaced apart from a downstream edge 752 of the shroud 728 and a downstream edge 758 of each of the rib supports 712. Accordingly, the downstream edge 780 extends in a downstream direction 746 a further extent than the downstream edge 752 of the shroud 708 and the downstream edge 758 of each of the rib supports 712.

Figure 13:
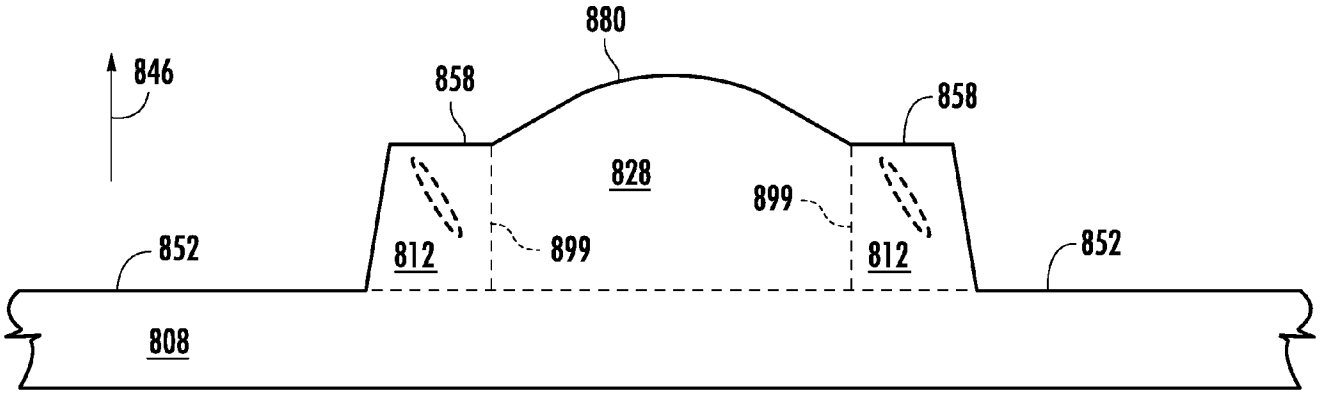
FIG. 13 is a side elevational view showing another embodiment of the acoustic members and the rib supports in an orientation similar to FIG. 6.

As shown in FIG. 13, an acoustic member 828 extends from an edge 852 of a shroud 808 and is integrally formed with rib supports 812. Vertical lines 899 define boundaries between the rib supports 812 and the acoustic member 828. The acoustic member 808 includes a non-linear (curved) downstream edge 880 that is spaced apart from a downstream edge 852 of the shroud 828 and downstream edges 858 of each of the rib supports 812. Accordingly, the downstream edge 880 extends in a downstream direction 846 a further extent than the downstream edge 852 of the shroud 808 and the downstream edge 852 of each of the rib supports 812.

Figure 14:
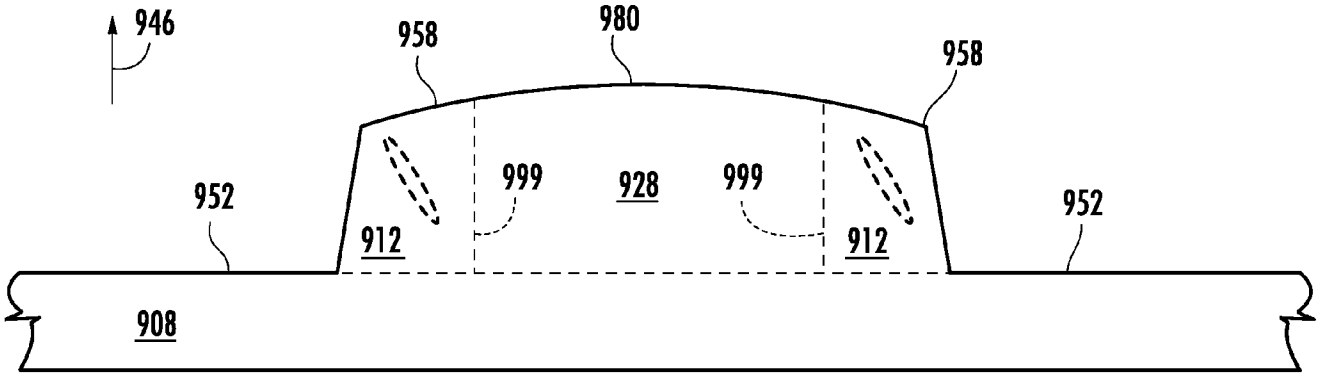
FIG. 14 is a side elevational view showing another embodiment of the acoustic members and the rib supports in an orientation similar to FIG. 6.

As shown in FIG. 14, an acoustic member 928 extends from an edge 952 of a shroud 908 and is integrally formed with rib supports 912. Vertical lines 999 define boundaries between the rib supports 912 and the acoustic member 928. The acoustic member 908 includes a non-linear downstream edge 980 that is spaced apart from the downstream edge 952 of the shroud 928 and the downstream edge 958 of each of the rib supports 912. Accordingly, the downstream edge 980 extends in a downstream direction 946 a further extent than the downstream edge 952 and the downstream edges 958.

Figure 15:
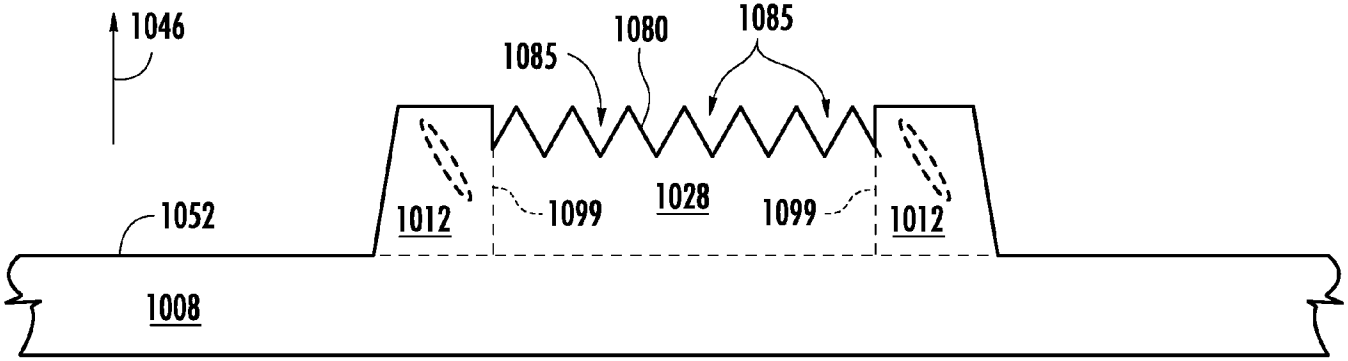
FIG. 15 is a side elevational view showing another embodiment of the acoustic members and the rib supports in an orientation similar to FIG. 6.

As shown in FIG. 15, an acoustic member 1028 extends from an edge 1052 of a shroud 1008 in a downstream direction 1046 and is integrally formed with rib supports 1012. Vertical lines 1099 define boundaries between the rib supports 1012 and the acoustic member 1028. The acoustic member 1008 includes a sawtooth downstream edge 1080 that is spaced apart from the downstream edge 1052 of the shroud 1028. The downstream edge 1080 defines numerous gap spaces 1085.

Figure 16:
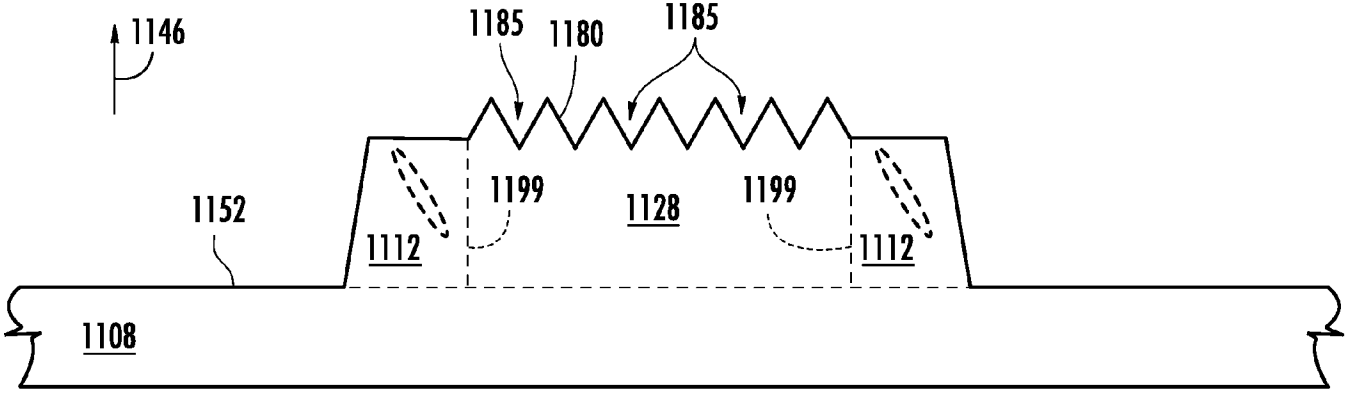
FIG. 16 is a side elevational view showing another embodiment of the acoustic members and the rib supports in an orientation similar to FIG. 6.

As shown in FIG. 16, an acoustic member 1128 extends from an edge 1152 of a shroud 1108 and is integrally formed with rib supports 1112. Vertical lines 1199 define boundaries between the rib supports 1112 and the acoustic member 1128. The acoustic member 1108 includes a sawtooth downstream edge 1180 that is spaced apart from the downstream edge 1152 of the shroud 1128. The downstream edge 1180 defines numerous gap spaces 1185.

Figure 17:
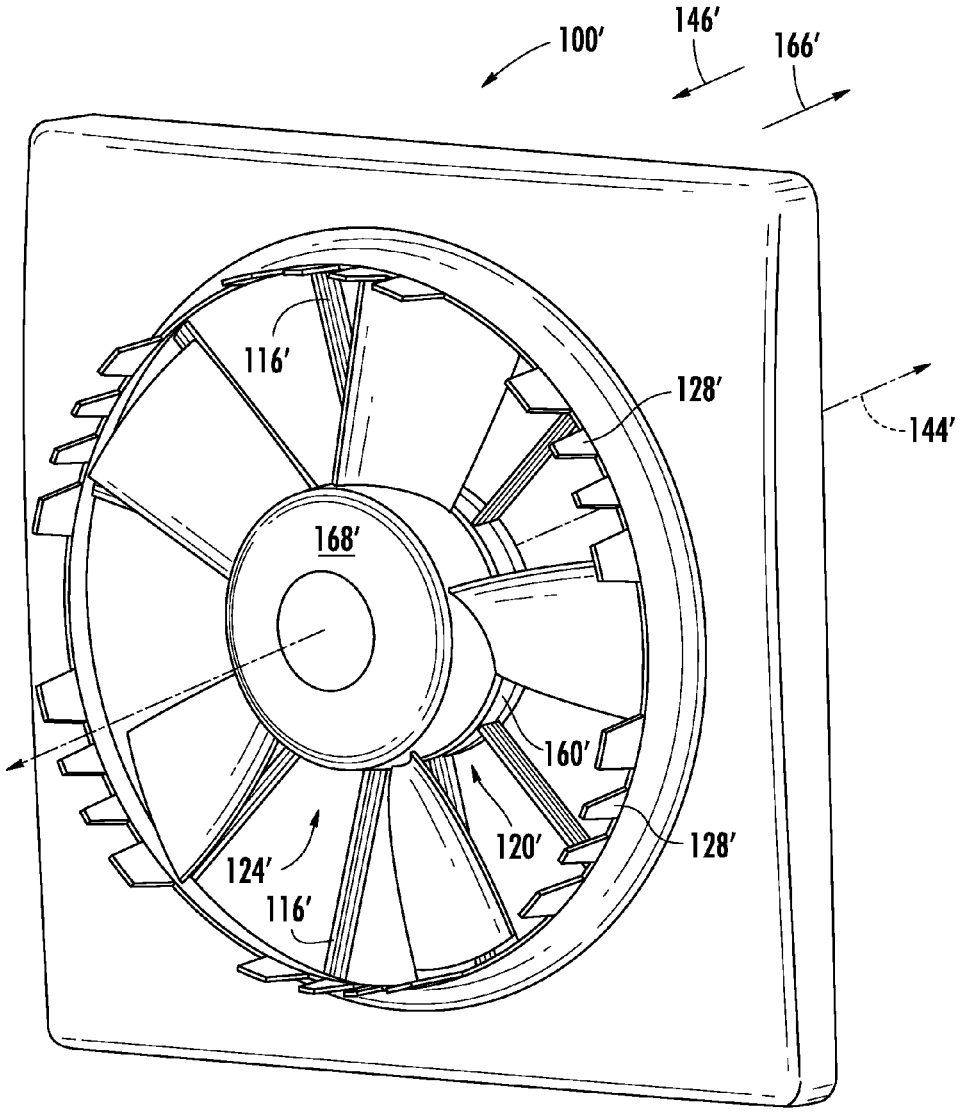
FIG. 17 is a perspective view of a downstream side of another embodiment of the airflow assembly, including a blade assembly positioned on a downstream side of a plenum of the airflow assembly.

FIG. 17 illustrates another embodiment of the airflow assembly 100' in which the fan assembly 124' extends from the fan support 120' in the downstream direction 146' instead of extending from the fan support 120' in the upstream direction 166' as shown in FIG. 4. Accordingly, the orientation of the fan support 120' is reversed, such that the cylindrical member 160' extends from a downstream side of the cover (not shown in FIG. 17, shown as 162 in FIG. 5). Due to the orientation of the fan assembly 124', the blade assembly 168' (which rotates about the an axis 144') is positioned on a downstream side of the ribs 116' nearer to the acoustic members 128'. Other than the differences described above, the airflow assembly 100' includes the same components and operates in the same manner as the airflow assembly 100.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An airflow assembly, comprising:

a plenum including an opening structure defining a plenum opening;

a barrel extending in a downstream direction from said opening structure, and defining a barrel space and a downstream edge;

a fan support at least partially positioned within said barrel space;

a fan assembly supported by said fan support and including a motor and a blade assembly configured to rotate about an axis; and a plurality of ribs, each of said ribs extending between (i) said opening structure or said barrel and (ii) said fan support, wherein said downstream direction is parallel to said axis, wherein an upstream direction is opposite of said downstream direction and parallel to said axis, wherein a plane intersects said axis and is perpendicular to said axis, wherein said downstream edge is of variable axial extent, and said barrel includes a first extent portion defining a first edge portion and a second extent portion defining a second edge portion, wherein said first edge portion is spaced apart from said plane in said downstream direction, wherein said second edge portion is spaced apart from said plane in said upstream direction, wherein each rib of said plurality of ribs (i) defines a first azimuthal extent, and (ii) extends from said opening structure or said barrel at a corresponding intersection region of said barrel, wherein each of said intersection regions defines a second azimuthal extent, wherein Y equals said first azimuthal extent, wherein X equals said second azimuthal extent, wherein $Y \leq X \leq 2.5Y$, wherein said first extent portion extends between a first intersection region and a second intersection region, wherein said second extent portion extends between said second intersection region and a third intersection region, wherein said airflow assembly is configured to be associated with a vehicle having underhood components, and wherein at least one of said first extent portion and said second extent portion (i) does not serve as an attachment structure or a guiding structure for said underhood components and/or (ii) does not accommodate an edge of a reinforcing rib extending between said plenum and said barrel.

2. The airflow assembly of claim 1, wherein:

said blade assembly includes a plurality of fan blades, each fan blade includes a terminal edge defining a tip length, said tip length equals T, said first extent portion and said second extent portion define a third azimuthal extent, said third azimuthal extent equals Z, and $0.25T \leq Z \leq 6.0T$.

3. The airflow assembly of claim 2, wherein:

said second edge portion is spaced apart from said first edge portion by a distance measured parallel to said downstream direction, said blade assembly rotates in a path of movement to define a cylinder, said cylinder defines a diameter, $\beta$ is a ratio of said distance to said diameter, and $0.015 < \beta < 0.300$.

4. An airflow assembly, comprising:

a plenum including an opening structure defining a plenum opening;

a shroud extending from said opening structure and defining a shroud space;

a fan support at least partially positioned within said shroud space;

a fan assembly supported by said fan support;

a plurality of rib supports extending from said shroud;

a plurality of ribs, each of said ribs extending between a corresponding one of said rib supports and said fan support; and at least one acoustic member extending from said shroud and being (i) circumferentially interposed between a corresponding circumferentially adjacent pair of said rib supports, and (ii) spaced apart from each of said corresponding circumferentially adjacent pair of said rib supports.

5. The airflow assembly of claim 4, wherein:

said plurality of rib supports includes a first rib support and a second rib support that are spaced apart from each other, said acoustic member is interposed between said first rib support and said second rib support, each of said first rib support and said second rib support extend from said shroud for a first distance, said acoustic member extends from said shroud for a second distance, and said first distance is less than said second distance.

6. The airflow assembly of claim 4, wherein the acoustic member is a first acoustic member, further comprising:

a second acoustic member extending from said shroud and being (i) circumferentially interposed between said corresponding circumferentially adjacent pair of said rib supports, and (ii) spaced apart from said corresponding circumferentially adjacent pair of said rib supports.

7. The airflow assembly of claim 6, wherein said first acoustic member is spaced apart from said second acoustic member to define a gap space therebetween.

8. The airflow assembly of claim 6, wherein:

said first acoustic member extends from said shroud for a first distance, said second acoustic member extends from said shroud for a second distance, said first distance is greater than said second distance, said plurality of rib supports includes a first rib support, said first rib support extends from said shroud for a third distance, said first distance is greater than said third distance, and said second distance is less than said third distance.

9. The airflow assembly of claim 6, wherein:

said first acoustic member is configured to define a first rectangular member, said second acoustic member is configured to define a second rectangular member, and said first rectangular member is larger than said second rectangular member.

10. The airflow assembly of claim 6, wherein:

said first acoustic member is configured to define a first triangular member, said second acoustic member is configured to define a second triangular member, and said first triangular member is larger than said second triangular member.

11. The airflow assembly of claim 4, wherein:

said plurality of ribs includes a first rib, said first rib defines a circumferential width, said acoustic member is spaced apart from said first rib by a gap space, and said gap space is approximately equal to said circumferential width.

12. The airflow assembly of claim 4, wherein the acoustic member is a first acoustic member, further comprising:

a second acoustic member extending from said shroud and being (i) circumferentially interposed between said corresponding circumferentially adjacent pair of said rib supports, and (ii) spaced apart from each of said corresponding circumferentially adjacent pair of said rib supports; and a third acoustic member extending from said shroud and being (i) circumferentially interposed between said corresponding circumferentially adjacent pair of said rib supports, and (ii) spaced apart from each of said corresponding circumferentially adjacent pair of said rib supports, wherein said second acoustic member is spaced apart from said first acoustic member to define a first gap space therebetween, and wherein said second acoustic member is spaced apart from said third acoustic member to define a second gap space therebetween.

13. The airflow assembly of claim 4, wherein:

said shroud defines an edge;

said plurality of rib supports extends from said edge in an extension direction; and said at least one acoustic member extends from said edge in said extension direction.

14. An airflow assembly, comprising:

a plenum including an opening structure defining a plenum opening;

a shroud extending from said opening structure and defining a shroud space;

a fan support at least partially positioned within said shroud space;

a fan assembly supported by said fan support and including a blade assembly configured to rotate about an axis;

a plurality of rib supports extending from said shroud;

a plurality of ribs, each of said ribs extending between a corresponding one of said rib supports and said fan support; and at least one acoustic member extending from said shroud, wherein a plane intersects said axis and is perpendicular to said axis, wherein each of said rib supports includes a first edge positioned in said plane, wherein said acoustic member includes a second edge, and wherein at least a portion of said second edge intersects said plane.

15. The airflow assembly of claim 14, wherein the acoustic member is a first acoustic member, further comprising:

a second acoustic member extending from said shroud.

16. The airflow assembly of claim 15, wherein said first acoustic member is spaced apart from said second acoustic member to define a gap therebetween.

17. The airflow assembly of claim 15, wherein:

said first acoustic member extends from said shroud for a first distance, said second acoustic member extends from said shroud for a second distance, and said first distance is greater than said second distance.

18. The airflow assembly of claim 17, wherein:

said plurality of rib supports includes a first rib support, said first rib support extends from said shroud for a third distance, said first distance is greater than said third distance, and said second distance is less than said third distance.

19. The airflow assembly of claim 15, wherein:

said first acoustic member is configured to define a first triangular member, said second acoustic member is configured to define a second triangular member, and said first triangular member is larger than said second triangular member.

20. The airflow assembly of claim 14, wherein:

said shroud defines a substantially circular edge;

said plurality of rib supports extends from said circular edge in an extension direction; and said at least one acoustic member extends from said circular edge in said extension direction.

* * * * *